US006973691B1

(12) United States Patent
Cordova et al.

(10) Patent No.: US 6,973,691 B1
(45) Date of Patent: Dec. 13, 2005

(54) HEAD, NECK AND UPPER BODY SUPPORT PILLOW

(76) Inventors: Lora May Cordova, 1673 Birch Rd., Rosholt, WI (US) 54473; Richard Patrick Cordova, 1673 Birch Rd., Rosholt, WI (US) 54473

( * ) Notice: Subject to any disclaimer, the term of this patent is extended or adjusted under 35 U.S.C. 154(b) by 32 days.

(21) Appl. No.: 10/867,542

(22) Filed: Jun. 14, 2004

(51) Int. Cl.[7] ..... A47G 9/00

(52) U.S. Cl. ..... 5/652; 5/657; 5/490; 248/118; 297/392; 297/393; 297/482

(58) Field of Search ..... 5/652, 657, 632, 5/636, 655, 9, 490; 297/392, 939, 391, 482; 248/118

(56) References Cited

U.S. PATENT DOCUMENTS

| | | | | |
|---|---|---|---|---|
| 2,172,178 | A * | 9/1939 | Rosenberg | 248/118 |
| 4,235,472 | A * | 11/1980 | Sparks et al. | 297/392 |
| 4,560,201 | A * | 12/1985 | Scott | 297/393 |
| 4,565,408 | A * | 1/1986 | Palley | 297/393 |
| 5,611,601 | A * | 3/1997 | Cowgur | 297/393 |
| 5,645,319 | A * | 7/1997 | Parks, Jr. | 297/391 |
| 6,135,560 | A * | 10/2000 | Fagg | 297/391 |
| 6,270,160 | B1 * | 8/2001 | Blake | 297/393 |
| 6,394,554 | B1 * | 5/2002 | Hingle | 297/482 |
| 6,721,978 | B1 * | 4/2004 | Tankersley | 5/652 |
| 2002/0050009 | A1 * | 5/2002 | Ley | 5/657 |

* cited by examiner

*Primary Examiner*—Alexander Grosz

(57) ABSTRACT

A portable, elongated support pillow that when propped between the chin and lap of the user limits both head and torso movements caused by resting or sleeping while sitting in an upright position. The pillow is a single unit having a top contour, a bottom contour and a center section. The top contour is a crescent shaped headrest that cradles the chin and face, the bottom contour conforms to the top of the user's thigh, and the center section connects the top contour to the bottom contour. The top and bottom sections have a wider width than the center section giving the pillow an hourglass-shape. The support pillow is encased in a cover having sling style pockets, adapted to accommodate a user's arms or a strap.

6 Claims, 2 Drawing Sheets

HEAD, NECK AND UPPER BODY SUPPORT PILLOW

BACKGROUND OF THE INVENTION

This invention relates to pillows or cushions designed to provide support which allows a person to sleep or rest comfortably while sitting in an upright position or to provide upper body support in various uses. Finding a comfortable position for resting or sleeping while sitting upright has been the basis for numerous inventions. Various solutions that involve support and pillow devices often require reclining seats, high backed seats, complicated setups, and adjacent objects. Rarely do these devices provide support for both the head and the torso of the user.

This invented head, neck and upper body support pillow provides support to both the head and torso without requiring reclining seats or adjacent objects, complicated setups or numerous moving parts. The following cited references refer to the most pertinent patents to which the inventor is aware of in regard to the subject matter of the present invention.

U.S. patent application No. 2002/0050009 (Ley) is a travel pillow made of an adjustable face pad and adjustable legs that rests on the lap. The adjustability comes from a variety of moving parts and shafts.

Advantages and novelty of the head, neck and upper body support pillow are its simplicity in design and use. To use this invention, simply prop the support pillow between the chin and thigh. Adjustability can be achieved by moving the support pillow up or down on the thigh to change the height of the chinrest. This invention does not contain moving parts making it easier to setup and less susceptible to malfunction. This invention is made of rigid yet soft materials making it safer and more comfortable to hold next to the body in rest and sleep situations.

U.S. Pat. No. 6,270,160 (Blake) is a head and neck support that has a top tray that supports the head and a bottom component which rests on the thigh and is made adjustable with a cylindrical compression shaft in the center of the device.

Advantages and novelty of the head, neck and upper body support pillow are its simplicity in design and adjustability. This invention has a crescent shaped top portion that provides total support to the head and neck. This invention is constructed of rigid yet soft materials making it comfortable to hold against the body in a sleep situation. This invention does not have moving parts making it easy to use and less susceptible to malfunction.

U.S. Pat. No. 6,394,554 (Hingle) refers to the "7"-shaped seat belt pillow that is shaped like a 7. To use, it is strapped to a shoulder seat belt and goes behind the head and over the shoulder of the user.

Advantages and novelty of the head, neck and upper body support pillow is it does not require a high backed seat or a seat belt. This invention does not require attachment to other objects making it easy to place or remove as needed.

U.S. Pat. No. 4,560,201 (Scott) is made of a strap device which is attached to the head of the user, goes under the armpit and connects to the user's forearm.

Advantages and novelty of the head, neck and upper body support pillow is that it provides support to both the head/neck and the torso. This head, neck and upper body support pillow is a single unit that does not require a setup. It simply gets propped between the chin and lap of the user. This invention does not go over the user's head and interfere with the user's hairstyle.

U.S. Pat. No. 4,565,408 (Palley) is a portable device with a collar-type support that wraps around the neck.

Advantages and novelty of the head, neck and upper body support pillow is that it provides head, neck and torso support. It does not require a setup and it can be easily placed and removed as needed.

U.S. Pat. No. 4,235,472 (Sparks) is several block-like pillows made of Styrofoam which stack up to provide a variety of uses. To use as a sleep aid, several Styrofoam pillows are stacked on the lap of the user and the user lies over the pillows.

Advantages and novelty of the head, neck and upper body support pillow are that it is a single, compact unit which is portable and ready to use as a sleep aid.

U.S. Pat. No. 5,645,319 (Parks, Jr.) is an inflatable pillow that is attached to a tray or surface directly in front of the user.

Advantages and novelty of the head, neck and upper body support pillow is that it provides head, neck and torso support without requiring a support tray or adjacent surface and can be easily placed and removed as needed.

U.S. Pat. No. 5,611,601 (Cowgur) is an inflatable, rectangular device that covers the lap of the user providing a surface to rest the arms and shoulders on requiring the user to lean their upper body over into the pillow.

Advantages and novelty of the head, neck and upper body support pillow are that it is compact and ready to use. It is ergonomic and supports the upper torso in an upright position without putting a strain on the user's back.

U.S. Pat. No. 6,135,560 (Fagg) is a pillow that provides support for the head and neck when placed between the user and an adjacent surface.

Advantages and novelty of the head, neck and upper body support pillow is that it provides support to both the head and neck and the torso. This invention does not require the use of other surfaces for support.

U.S. Pat. No. 6,721,978 (Tankersley) is a pillow device that is placed on a surface in front of the user to cushion the user's head and upper body when they lean over to lay on the surface.

Advantages and novelty of the head, neck and upper body support pillow is that it does not require the use of other surfaces for support.

BRIEF SUMMARY OF THE INVENTION

A pillow used to support the head, neck and upper body of a user while sitting in an upright position. The device is designed to limit both head and falling forward movements of users sitting in upright positions who are sleeping or who lack muscle strength due to age or disease. To use the pillow, the pillow is placed between the chin and lap of the user. The object of this pillow is to provide support that limits a person's head, neck and torso movements while resting in an upright seated position. The pillow is compact, portable, easy to use, comfortable and does not require the use of other surfaces for support.

The pillow is a single unit that can be described in three main components.

1. A crescent shaped head and chin rest of sufficient size to cradle the human head. One side of the crescent shape is longer. The longer side extends up the side of the head and face. The shorter side cradles the chin. This design allows for a comfortable fit for a variety of head shapes without being restrictive.
2. A center section, which is a narrower width than the upper and lower sections, connects the headrest to the stabilizing lap base.
3. A contoured bottom, shaped to fit over the top of the thigh, stabilizes the device. This bottom has a downward facing, shallower crescent shape. The longer side extends down the outside of the thigh to provide rigidity and stability to the pillow. The shorter side curves toward the inner thigh to prevent slippage without being obtrusive.

The pillow is encased in a removable, washable cover having sling-type pockets located on the center section on both the front and back side of the pillow. When the user's arms are inserted into the pocket, the pocket supports the arms and allows the user to "hug" the pillow close to the body and further stabilize the pillow. Pockets on both sides allow the pillow to be used on the left or right side of the body.

DETAILED DESCRIPTION OF THE INVENTION

Figure 1:
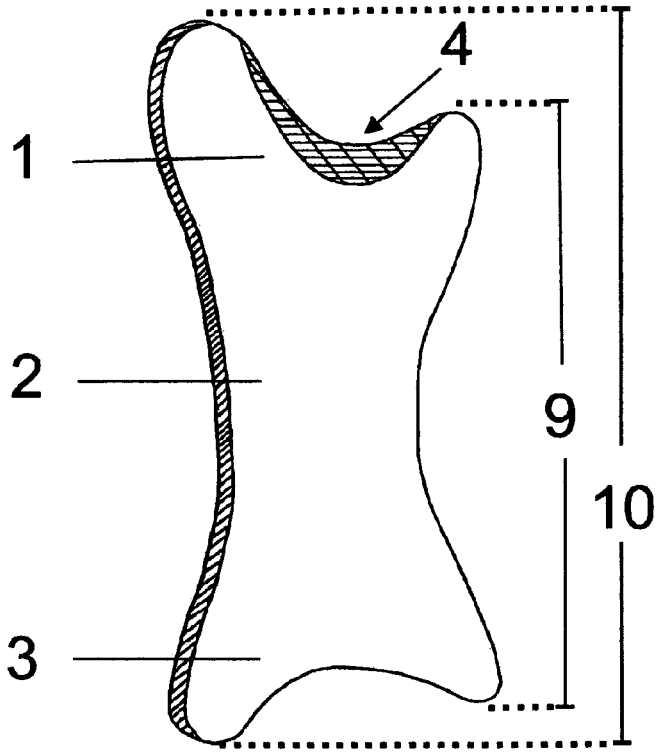
FIG. 1 illustrates a front view of the pillow without a cover. The back view of the pillow is a mirror image of the front view.
Figure 2:
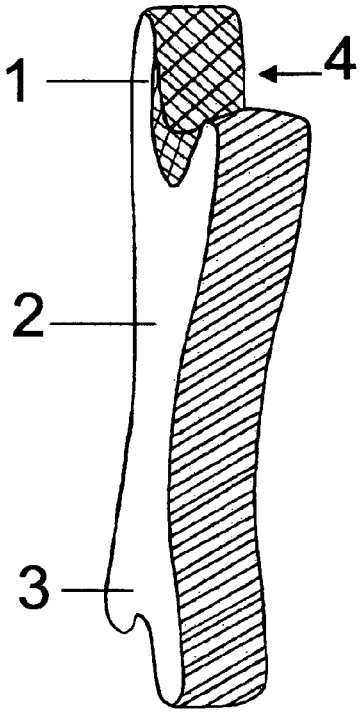
FIG. 2 illustrates a perspective view of the pillow shown in FIG. 1.

The pillow can be constructed of a wide variety of materials. In a broad overview, this support pillow can be constructed of any foam, cotton, beads, beans, air, water, gell or any material or combination of materials that is comfortable and resilient yet rigid/dense enough to maintain an upward shape that limits the head, neck and torso movements of the human body while resting or sleeping in an upright position. The top, center and bottom portions of the pillow can be constructed of the same material or different materials or combination of materials. A cover supplied with the pillow can be made of cloth, fabric, plastic, vinyl, leather, foam, rubber, disposable spun bonded polypropylene, or any material or combination of materials to increase the comfort, support and/or the aesthetic appearance of the pillow. In the following embodiments, specific details are described but it should be understood that variations and modifications may be made to this invention without departing from the spirit and scope of this invention and that the invention is not limited to the precise embodiments described herein.

In its preferred embodiment, the head, neck and upper body support pillow is of simple construction. The detailed drawings show the pillow, in its preferred embodiments, constructed of foam that is rigid enough to maintain its shape yet soft enough to be comfortable against the body. (For travel purposes, an inflatable pillow that can be deflated offers space saving benefits. The inflatable pillow will have the same components and similar properties as the aforementioned foam when referring to its rigidity and softness and will function in the same manner but will vary slightly in construction, e.g. an inflatable bladder with or without baffles for adjustability and an air intake valve or valves.)

REFERRING TO THE DRAWINGS

FIG. 1, is a drawing of the pillow as a single unit with a top section 1, a center section 2 and a bottom section 3. The pillow illustrated is constructed of foam. The foam has a density of approximately 1.5 to 2 lb/cu/ft and a 50 to 100 i.f.d. The inside portion of the upper crescent 4 in FIG. 1 is constructed of a softer foam making the chinrest more comfortable. The main components of the pillow are defined as 1, 2, and 3 in the drawings. The top crescent shaped portion 1 is designed to cradle a person's head, chin and face. One side of the crescent shape 1 is longer and extends up the side of the head and face of the user. The shorter side cradles the user's chin. Softer foam 4 located on the inside of the upper contour adds to the comfort of the pillow but is not relevant to the function of the pillow. The center portion 2 is designed to support and connect the top 1 and bottom 3 portions of the pillow. The center portion is a narrower width than the top and bottom portions. The bottom portion 3 is a downward-facing crescent shape designed to fit comfortably on a person's upper thigh. The longer side of the crescent extends along the outside of the thigh. The shorter side curves toward the inner thigh. The overall height of the pillow 10 is the area from the highest point on the top section 1 to the lowest point on the bottom section 3. The portion of the pillow that fits between the chin and lap of the user is referred to as detail 9 which is the area between the lowest point of the upper contour 1 and the highest point of the bottom contour 3.

Figure 3:
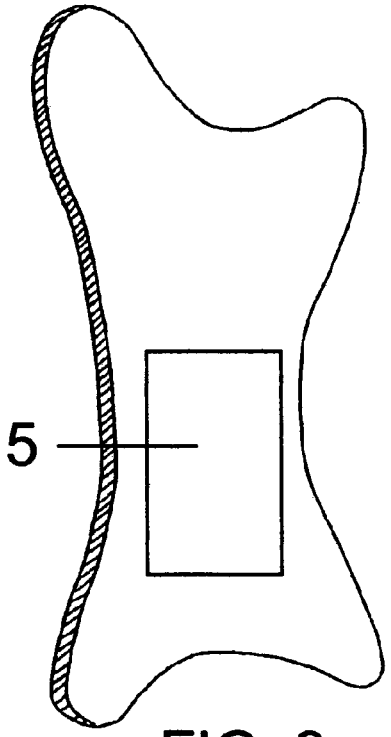
FIG. 3 illustrates a front view of the pillow shown in FIG. 1 with a cover. The back view of the pillow cover is a mirror image of the front view. Both sides have a pocket.
Figure 4:
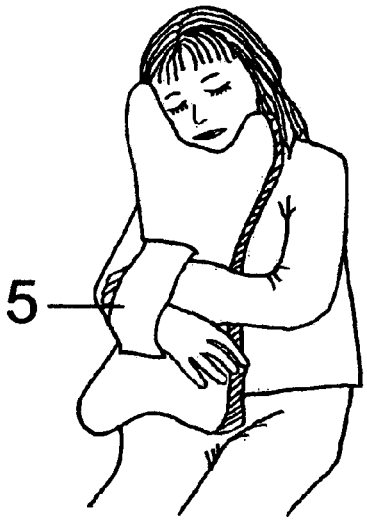
FIG. 4 illustrates the pillow in use. The pillow is propped between the chin and thigh of a person who is resting while sitting in an upright position. The person's arms are inserted in the front pocket.

In its preferred embodiment, the pillow has a cover that is form-fitted, removable and washable. The cover is made of a soft fabric such as polar fleece. The chinrest portion of the cover can be constructed of a different fabric or combination of fabrics and foam, fiberfill, or combination of materials that add to the comfort of the chinrest against the user's face. The pillow cover shown in FIG. 3 has a sling-like pocket 5 located in the center section on both the front and back sides that can be used to support the arms and allows the pillow to be held close to the body to prevent the pillow from sliding. FIG. 4 illustrates a girl with her arms inserted into the pocket 5 of the pillow cover. The pillow is simply propped between her chin and lap. The user's face and chin are resting in the upper contour 1 and the bottom portion 3 contours her upper thigh. The center portion 2 is narrowed making the pillow more compact and easier to hug close to the body.

Figure 5:
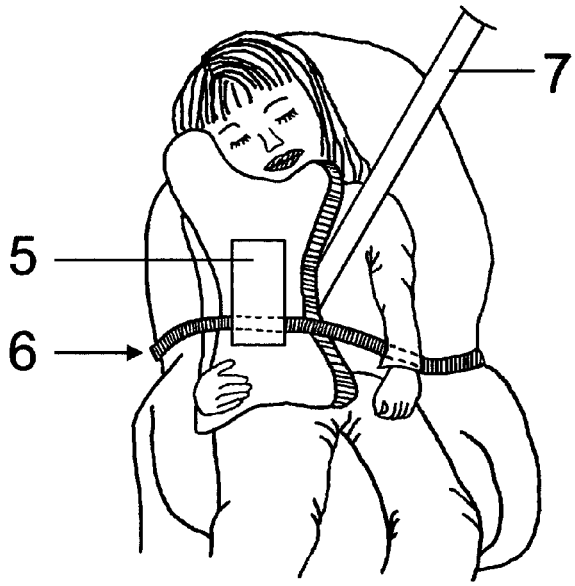
FIG. 5 illustrates the pillow in use by a young child sitting in a toddle car seat. A strap that is inserted through the pocket holds the pillow in place on the toddler's lap.
Figure 6:
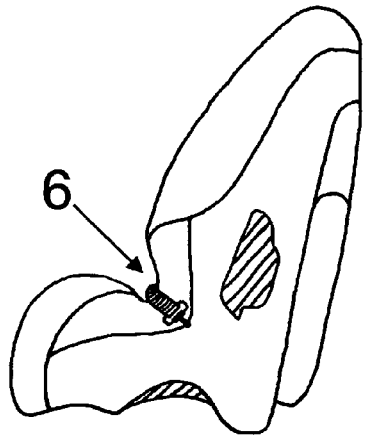
FIG. 6 illustrates the side view of the toddler car seat shown in FIG. 5 showing how the strap is attached to the side edge of the car seat. The other side of the strap is hooked to the opposite side edge of the car seat.

FIG. 5 shows the pillow being used by a young child in a toddler car seat. A strap 6, rather than the child's arms, is inserted through the pocket. The strap is not a requirement for using the pillow. The strap is optional and can be used alone or in conjunction with the user's arms to hold the pillow more securely on the user's lap. In FIG. 5 the pillow is placed on the lap of the child only after the child has been secured in the vehicle with the shoulder restraint seat belt 7 so that the pillow does not interfere with the safety of the vehicle's seat belt. The strap 6 has an adjustable length of approximately 24 to 48 inches and has hooks or clips on both ends. The strap can be constructed of canvas, woven polyester, or similar material. FIG. 6 shows how the hook on the end of the strap 6 clips to the side of the pictured car seat. The hook on the other end of the strap is hooked to the opposite side of the car seat and the strap is then adjusted. The strap 6 is pictured being hooked to the side of the child's car seat for illustrative purposes only since the type of chair a user is sitting in will vary. Hence, the strap 6 can be hooked or clipped to any appropriate surface or it can encircle the user's torso and the two ends of the strap can be hooked together.

Figure 7:
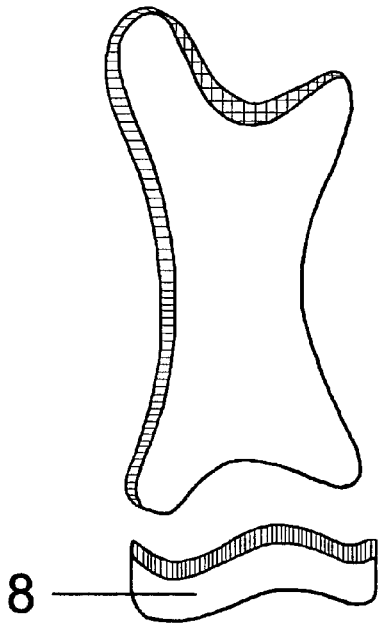
FIG. 7 illustrates the pillow above an additional contoured block of foam.
Figure 8:
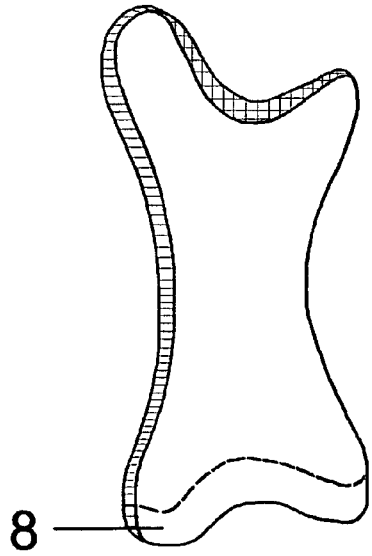
FIG. 8 illustrates the pillow with the block fitted to the bottom contour of the pillow to show how the additional block adds height to the pillow.

The pillow can adjust to fit a wide variety of body heights in the following three ways:

1. A pillow of the same size can easily fit users of different body heights by simply moving the bottom contour 3 of the pillow up or down the thigh. When the bottom contour 3 is slid down on the thigh, the upper contour 1 is lowered. When the lower contour 3 is slid higher on the thigh and closer to the body the upper contour 1 is raised. A taller person with a longer torso can raise the height of the chinrest 1 by sliding the bottom 3 up the thigh whereas a shorter person with a shorter torso can lower the height of the chinrest 1 by sliding the bottom 3 down the thigh.
2. FIG. 7 shows the pillow pictured above a foam block that is contoured to fit into the bottom contour of the bottom section 3. When the foam block 8 is fitted to the bottom contour of the pillow it will increase the height of 9 and 10. The block 8 raises the height of the upper contour 1. This is illustrated in FIG. 8 when the block 8 or several blocks stacked together are fitted to the bottom contour 3 and the overall height 10 of the pillow and the height 9 between the top and bottom contours both increase. Removing or placing the block or blocks from the bottom contour will adjust the height desired by the user.
3. To fit a wide range of ages and body heights, the pillow can be various sizes such as small, medium and large. Small to fit toddlers and young children, medium to fit adolescents and small adults, and large to fit most adults. The general shape of the pillow will remain the same for all three sizes. The main change will be to resize the overall height 10 in FIG. 1 in increments of approximately 5 inches which proportionately changes the height 9 between the chin and lap by approximately 5 inches. This change is relative to the average torso length of toddlers, older children and adults. The height 10 is approximately 15 inches for the small sized pillow, approximately 20 inches for the medium sized pillow, and 25 inches for the large sized pillow. The overall width of the pillow will widen or narrow slightly by a few inches to accommodate the different sized heads, thighs and arms of the various age groups and body heights. The thickness of the pillow, approximately 2 to 4 inches, can remain constant for all sizes. It is to be understood by persons skilled in the art that even though reference is made to a specific support and travel pillow, any variations of this invention which utilize the features described are to be considered part of this invention.

We claim:

1. A portable, elongated pillow designed to fit between the chin and lap of the user providing support to the head, neck and upper body of a person who is sitting in an upright position while resting or sleeping or lacking muscle strength due to disease or age, comprising:

a crescent shaped top portion contoured to cradle the face and chin of the human head with a longer side of the crescent extending up the side of the face and a shorter side cradling the chin allowing room for the user's head to tilt at any angle they find comfortable;

a center portion narrower than the top portion and a bottom portion, the center portion adapted to support the pillow in an upright position and connects the top and bottom portions;

the bottom portion being contoured to conform to the top of the thigh of a user and helps to stabilize the pillow on the user's lap in an upright position; and a cover adapted to removably encase said pillow, the cover having a sling style pocket located centrally on the front side thereof, the sling style pocket adapted to accommodate the arms of a user, whereby when the arms of a user are inserted in said pocket, the pillow may be stably held against the body of the user.

2. The pillow as defined in claim 1 having dimensions of approximately 15 to 25 inches high, approximately 8 to 14 inches wide and approximately 2 to 4 inches thick.

3. The pillow as defined in claim 1 is comprised of foam, air, beans, beads, batting, water, buckwheat, gel, visco-elastic, temperature sensitive or any material or combination of materials that are rigid enough to maintain an upright, vertical shape while supporting the user's head, neck and upper body yet resilient enough to be comfortable against the face, chin, and lap when propped between the chin and thigh of the user who is sitting in an upright position.

4. The pillow as defined in claim 1, wherein the cover has a sling style pocket located centrally on the back side thereof.

5. The pillow as defined in claim 4, further comprising a strap adapted to be inserted in one of said pockets, said strap made of canvas, woven polyester or similar material and has an adjustable length of approximately 24 to 48 inches with hooks or clips on both ends that clip to the back or bottom of the user's seat or wrap around the torso of the user and clip or hook together to help hold the pillow on the user's lap.

6. The pillow as defined in claim 1, further including at least one block of material that when added to the bottom contour of the pillow, increase the height of the of the pillow between the chin and lap, hence raising the height of the contour on which the chin rests.

* * * * *